US006923316B2

(12) United States Patent
Carty et al.

(10) Patent No.: US 6,923,316 B2
(45) Date of Patent: Aug. 2, 2005

(54) MAILER PACKAGE

(75) Inventors: James Patrick Carty, Mt. Laurel, NJ (US); Christina Marie Peterson, Barrington, NJ (US); Richard Weintraub, Moorestown, NJ (US); Jeffrey S. Osnato, Cranford, NJ (US); Linda Ann Carr, Mt. Laurel, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/996,233

(22) Filed: Nov. 23, 2004

(65) Prior Publication Data

US 2005/0087469 A1 Apr. 28, 2005

Related U.S. Application Data

(62) Division of application No. 10/427,571, filed on May 1, 2003, now Pat. No. 6,868,964.

(60) Provisional application No. 60/445,080, filed on Feb. 5, 2003.

(51) Int. Cl.[7] ..... B65D 69/00

(52) U.S. Cl. ..... 206/232; 206/45.29; 229/240

(58) Field of Search ..... 206/223, 232, 206/45.28, 45.29, 459.5, 461, 776–778, 806; 40/310, 312; 229/120.011, 120.01, 120.012, 210, 240, 307, 313

(56) References Cited

U.S. PATENT DOCUMENTS

| | | | | |
|---|---|---|---|---|
| 1,903,540 | A | | 4/1933 | Webster |
| 2,799,391 | A | | 7/1957 | Eisner |
| 3,241,738 | A | | 3/1966 | Freiman |
| 3,294,233 | A | | 12/1966 | Hollinger |
| 3,811,565 | A | | 5/1974 | Tancredi |
| 3,985,232 | A | * | 10/1976 | Johnson ..... 206/461 |
| 4,130,197 | A | * | 12/1978 | Fox ..... 206/45.29 |
| 4,152,865 | A | | 5/1979 | Ikeda |
| 4,203,516 | A | | 5/1980 | Stonoga et al. |
| 4,365,438 | A | | 12/1982 | Nelson |
| 4,407,442 | A | * | 10/1983 | Watson et al. ..... 229/120.18 |
| 4,874,087 | A | * | 10/1989 | Mayne ..... 206/362.4 |
| 4,905,828 | A | | 3/1990 | Dods |
| 5,038,930 | A | | 8/1991 | Holtkamp, Jr. |
| 5,232,087 | A | | 8/1993 | Schluger |
| 5,293,994 | A | | 3/1994 | Antik |
| 5,358,176 | A | | 10/1994 | Rigby |
| 5,370,223 | A | | 12/1994 | Leicht, Jr. |
| 5,487,826 | A | | 1/1996 | Back et al. |
| 5,497,876 | A | | 3/1996 | Fleming |
| 5,626,286 | A | | 5/1997 | Petkovsek |
| 5,927,495 | A | | 7/1999 | Didiano, Jr. |
| 5,961,149 | A | | 10/1999 | Hunt |
| 6,070,719 | A | | 6/2000 | Pollock |
| 6,206,750 | B1 | | 3/2001 | Barad et al. |

* cited by examiner

*Primary Examiner*—Luan K. Bui
(74) *Attorney, Agent, or Firm*—Akin Gump Strauss Hauer & Feld, LLP

(57) ABSTRACT

A mailer package formed from a single sheet of foldable stock material includes a compartment formed by first and second parallel panels joined together by first and second parallel sides. The sides extend along opposing edges of the panels. The compartment has opposing first and second open ends, with a number of tabs sufficient to cover and close each open end. A cover extends from an edge between one of the sides and panels. The cover has a closure flap with a tearable pull tab and is foldable between a closed position overlying a panel or side adjacent to the edge from which it extends, and an open position folded away from the compartment. The cover is releasably secured in the closed position by attachment of the closure flap to another panel or side. The secured cover is moveable to the open position with release of the pull tab.

8 Claims, 9 Drawing Sheets

MAILER PACKAGE

CROSS-REFERENCE TO RELATED APPLICATION

This application is a non-provisional of U.S. Provisional Patent Application No. 60/445,080, filed on Feb. 5, 2003, the disclosure of which is incorporated herein by reference. This application is also a division of application Ser. No. 10/427,571, filed May 1, 2003 now U.S. Pat. No. 6,868,964 entitled "Mailer Package".

BACKGROUND OF THE INVENTION

The invention relates generally to mailer packages, and more particularly to cardboard mailer packages configured for sending a gift in the form of a toy along with a greeting inscribed on the mailer package.

Mailer packages are generally known in the art, and take a variety of shapes and sizes depending on the desired package size. Mailer packages are often made from a single sheet of stock material, such as cardboard. The mailer package is formed by folding the stock material at designated points, thereby producing a simpler, stronger package since there are a minimal number of joints which need to be artificially joined. Additionally, mailer packages often include a cover portion, such that the package may be closed and subsequently opened to retrieve the contents.

However, there remains difficulty in the art in forming mailer packages which are strong enough to hold heavier, larger objects within and still function as a delivery mechanism which can easily be sealed for shipping and easily be re-opened upon receipt, while still being formed from a single sheet of foldable stock material. Additionally, those utilizing such mailer packages to ship sample or gift products often desire to include a message or greeting with the mailer package. Although mailer packages which are used as greeting cards are known in the art, there has been difficulty in finding an effective way to use the mailer package as a greeting card while still maintaining the above-identified construction and strength characteristics. Thus, the present invention is directed to a mailer package which can be used as a greeting card while simultaneously shipping a toy secured within the package.

BRIEF SUMMARY OF THE INVENTION

According to a first aspect of the present invention, a mailer package formed from a single sheet of foldable stock material comprises a compartment formed by first and second parallel panels which are spaced from each other and joined together by first and second parallel sides. The first and second sides are smaller than the first and second panels and extend along opposing edges of each of the first and second panels. The compartment has opposing first and second open ends. A number of separate tabs at each of the first and second open ends each extend from a separate one of the first and second panels or first and second sides at the open end. There are a sufficient number of tabs to cover and close the first and second ends. A cover extends from an edge between one of the first and second sides and one of the first and second panels. The cover has a closure flap with a tearable pull tab and is foldable about the edge from which it extends between a closed position and an open position. In the closed position the cover overlies one of the first and second panels and the first and second sides adjacent to the edge from which it extends. The cover is releasably secured in the closed position by attachment of the closure flap to another of the first and second panels and the first and second sides. The secured cover is moveable to the open position with release of the pull tab. In the open position the cover is folded away from the compartment. The cover is formed from two mutually overlying layers of the stock material such that the two overlying layers of the stock material of the cover overlie a major portion of the one of the first and second panels and the first and second sides.

According to a second aspect of the present invention, a mailer package formed from a single sheet of foldable stock material comprises a compartment formed by first and second parallel panels which are spaced from each other and joined together by first and second parallel sides. The first and second sides are smaller than the first and second panels and extend along opposing edges of each of the first and second panels. The compartment has opposing first and second open ends. A number of separate tabs at each of the first and second open ends each extend from a separate one of the first and second panels or first and second sides at the open end. There are a sufficient number of tabs to cover and close the first and second ends. A cover extends from an edge between one of the first and second sides and the first and second panels. The cover is foldable about the edge from which the cover extends between a closed position overlying the compartment and an open position folded away from the compartment. The cover includes a closure flap having a tearable pull tab. The closure flap is cut from an interior area of the single sheet of foldable stock material which forms the package.

According to a third aspect of the present invention, a mailer package formed from a single sheet of foldable stock material comprises a first panel having opposing first and second major sides. The first panel has a closure flap with a tearable pull tab extending from a first edge. A compartment flap extends from a second edge of the first panel and is foldable about the second edge. The compartment flap has an attachment tab and forms a compartment having first, second, third and fourth sequentially adjoining sides by attachment of the attachment tab to one of the first and second major sides of the first panel. The first, second and third sides of the compartment are formed by folds in the compartment flap. The fourth side of the compartment is formed by the one of the first and second major sides of the first panel. The compartment has opposing first and second open ends. A number of separate tabs at each of the first and second open ends extend from a separate one of the first and second panels or one of the first and second sides at the open end. There are a sufficient number of tabs to cover and close the first and second ends. A cover extends from a third edge of the first panel and is foldable about the third edge between a closed position and an open position. In the closed position the cover overlies the other of the first and second sides of the first panel. The cover is releasably secured in the closed position by attachment of the closure flap to the cover. The secured cover is moveable to the open position with release of the pull tab. In the open position the cover is folded away from the first panel.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
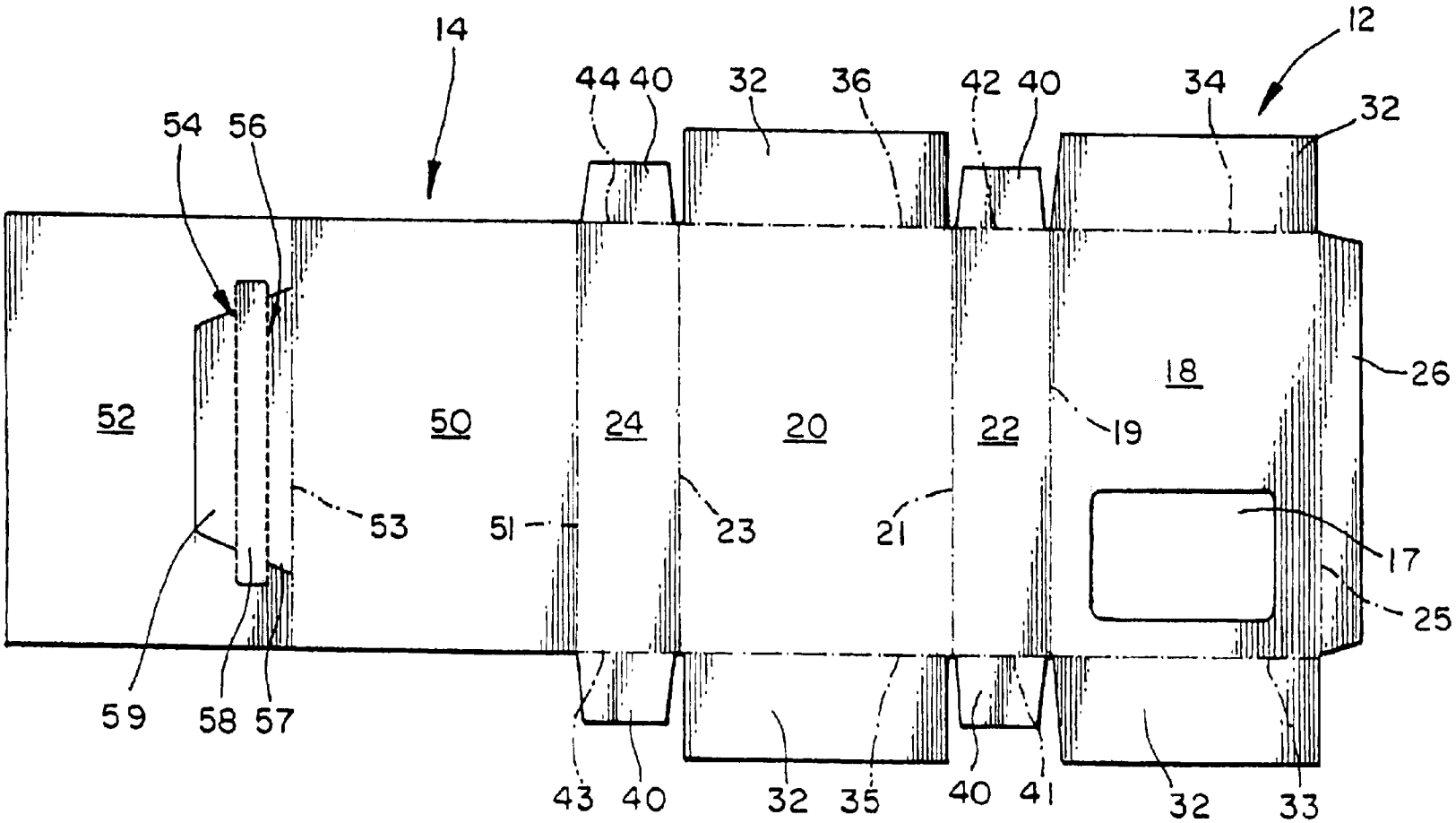
FIG. 1 is a top view of a blank of stock material used to form a mailer package according to a first embodiment of the present invention.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of the mailer package and designated parts thereof. The terminology includes the words above specifically mentioned, derivatives thereof and words of similar import.

Referring to the drawings in detail, wherein like numerals indicate like elements throughout, there is shown in FIGS. 1–4 a preferred embodiment of a mailer package, generally designated 10, for mailing a second, smaller package containing a toy or other similar device in accordance with the present invention. The mailer package 10 is preferably formed from a single sheet of foldable stock material, such as cardboard, of uniform thickness and composition and which is foldable along designated places in the stock material to form the mailer package 10. Those skilled in the art will recognize that the mailer package 10 could be formed from other stock material, such as a light plastic, without departing from the spirit and scope of the present invention.

Referring now to FIG. 1, a cardboard blank 12 of the stock material which forms the mailer package 10 is shown. The blank 12 forms a compartment 16 (see FIGS. 2–4) which includes first and second parallel panels 18, 20, respectively. The first and second panels 18, 20 are preferably approximately the same shape and size. The first panel 18 includes a generally rectangular shaped aperture 17, formed from a cut out of the stock material from the blank 12.

The blank 12 further includes first and second sides 22, 24, respectively, which are parallel in the compartment 24 and which extend along opposing edges of the first and second panels 18, 20. The first and second sides 22, 24 preferably have the same dimensions as each other, but are preferably smaller than the first and second panels 18, 20. The first and second sides 22, 24 have a length which is approximately equal to the lengths of the first and second panels 18, 20. The first side 22 extends from the first panel 18 along a first fold line 19 in the stock material. The first fold line 19 defines a first edge of the first panel 18 and the first side 22. The first side 22 similarly extends from the second panel 20 along a second fold line 21 which defines a second edge of the first side 22 and the second panel 20. The second side 24 extends from the second panel 20 along a third fold line 23 which defines a first edge of the second panel 20 and the second side 24.

A closure tab 26 extends from the first panel 18 along the length of a fourth fold line 25 which defines a second edge of the first panel 18. The closure tab 26 is preferably coated with an adhesive material on a surface thereof. The adhesive material is strong enough to securely attach the closure tab 26 to another portion of the stock material.

Panel tabs 32 extend from each end of the first panel 18 along panel tab fold lines 33, 34, which define third and fourth edges, respectively, of the first panel 18. Panel tabs 32 also extend from each end of the second panel 20 along panel tab fold lines 35, 36 which define third and fourth edges, respectively, of the second panel 20. Similarly, side tabs 40 extend from each end of the first side 22 along side tab fold lines 41, 42. The side tab fold lines 41, 42 define third and fourth edges, respectively, of the first side 22. Side tabs 40 extend from each end of the second side 24 along side tab fold lines 43, 44 which define third and fourth edges, respectively, of the second side 24.

The blank 12 further defines a cover 14 (see FIGS. 2–4), formed from first and second parallel cover panels 50, 52, respectively. The first cover panel 50 extends from the second side 24 along the length of a fifth fold line 51, which defines a second edge of the first cover panel 50 and the second side 24. The second cover panel 52 extends from the first cover panel 50 along the length of a cover fold line 53 which defines a first edge of the first and second cover panels 50, 52. The first and second cover panels 50, 52 have preferably approximately the same dimensions as the first and second panels 18, 20. The second cover panel 52 includes a cut-out portion 54 extending from the cover fold line 53. As shown in FIG. 1, the cut-out portion 54 is preferably formed on the interior of the blank 12 itself. That is, the cut-out portion 54 is formed within the borders of the first and second cover panels 50, 52 which define the cover 14. A closure flap 56 is formed from the cut-out portion 54 and is foldable about the cover fold line 53. The closure flap 56 preferably includes a perforated pull tab 58, preferably in the form of a zip strip formed by lines of perforations **58*a*, 58*b* (see FIG. 4), which separates the closure flap 56 into a release portion 57 and an attachment portion 59**.

Figure 2:
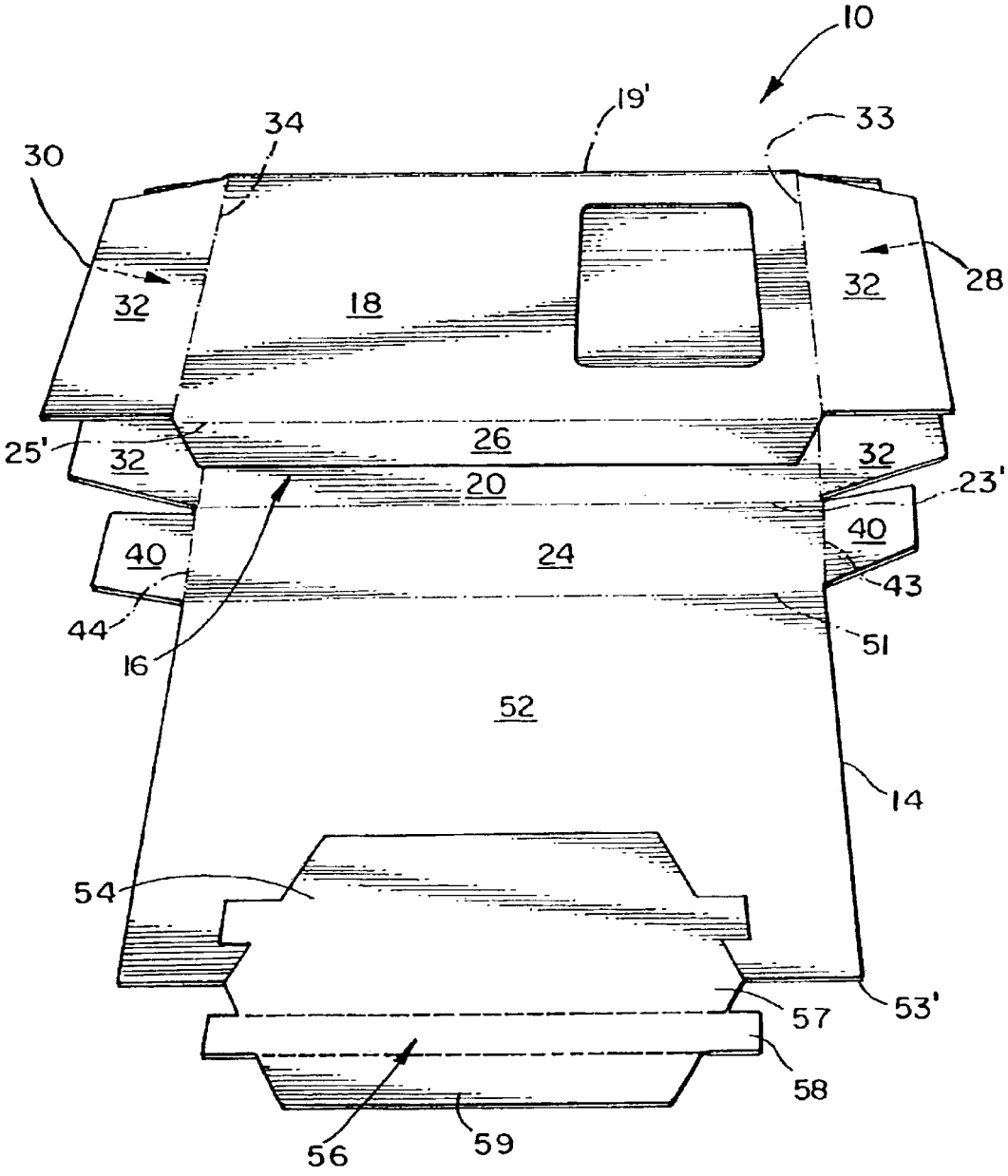
FIG. 2 is a top perspective view of a partially assembled mailer package formed from the blank shown in FIG. 1.
Figure 3:
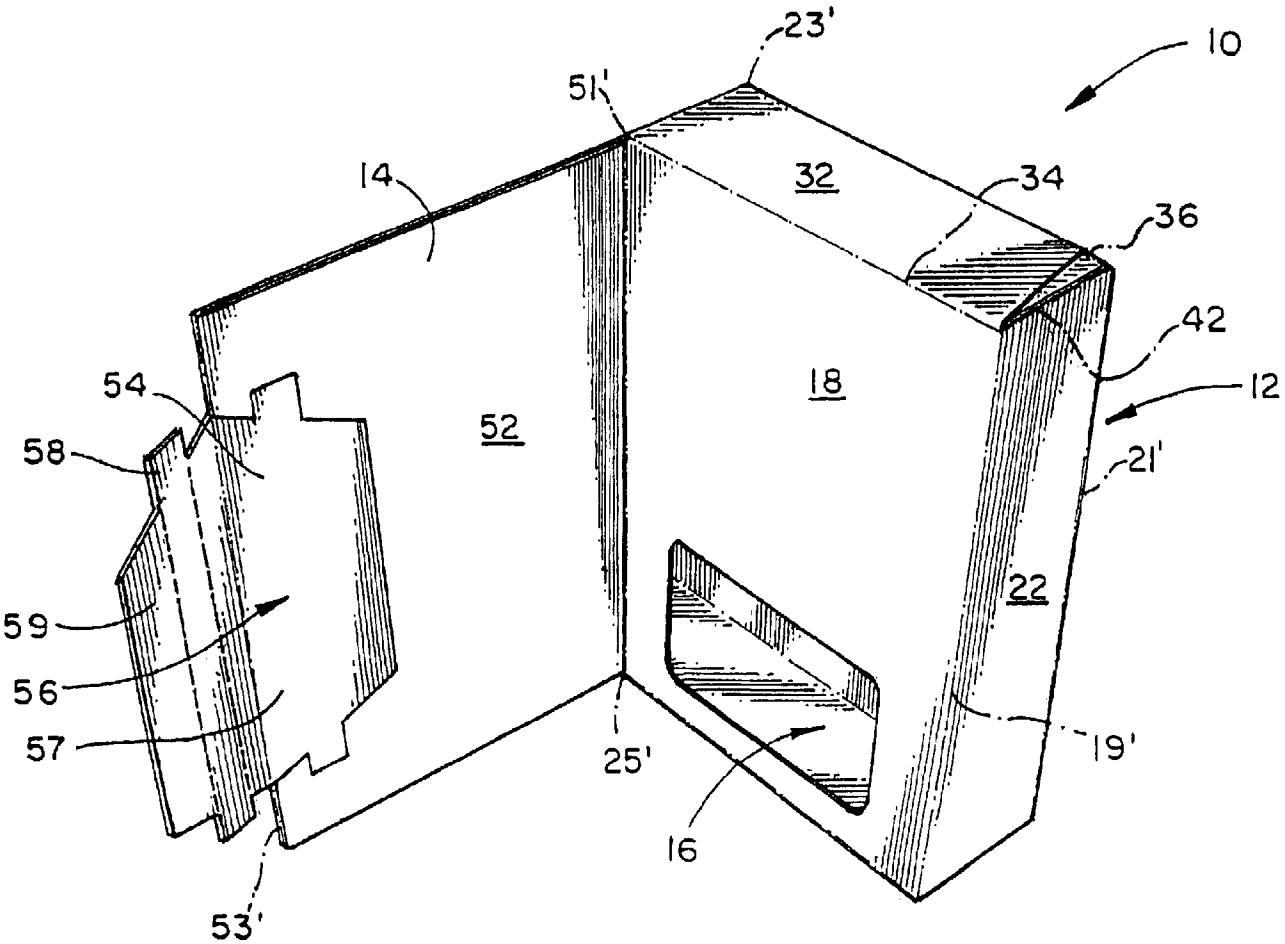
FIG. 3 is a perspective view of the mailer package of FIG. 2 in the open position.
Figure 4:
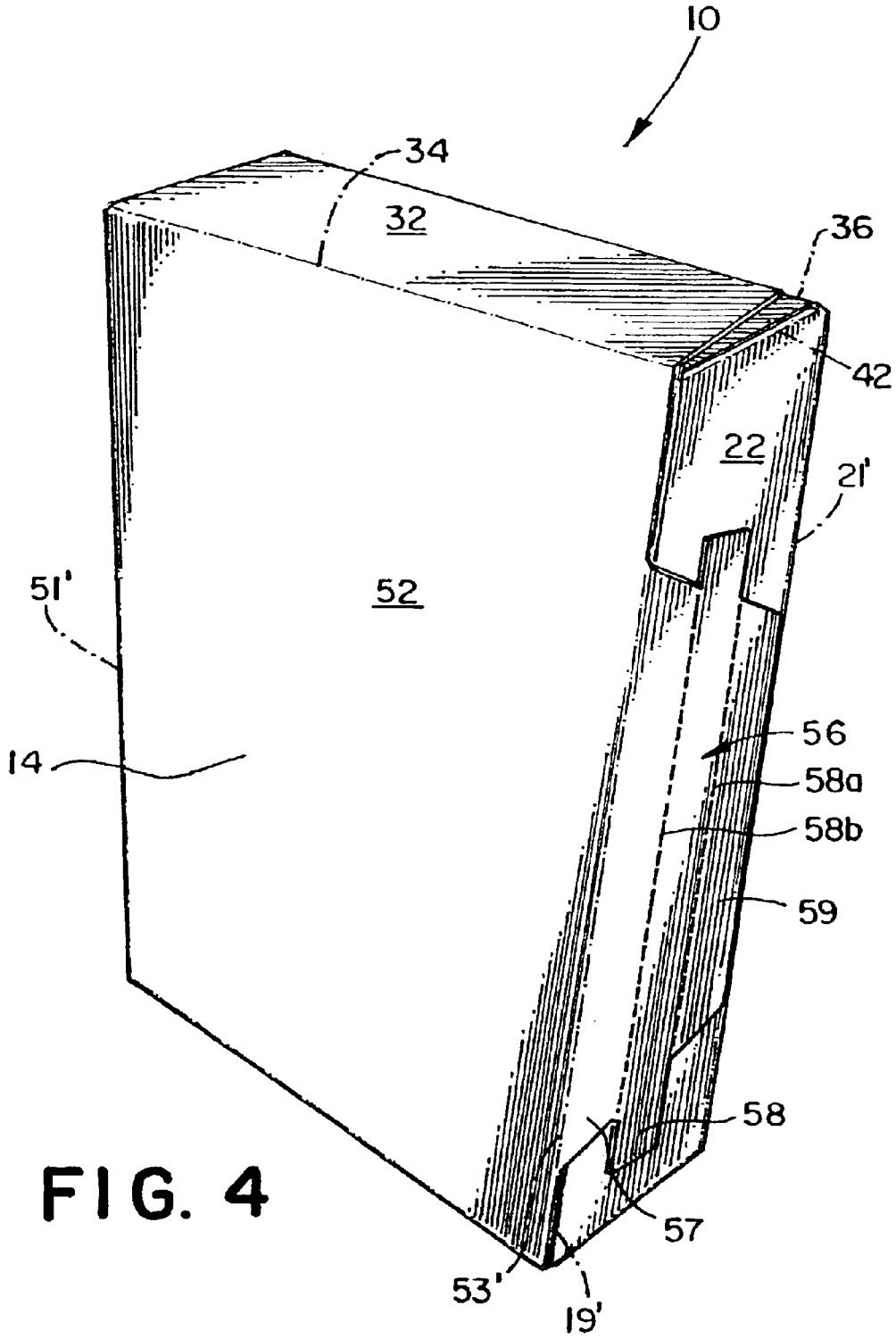
FIG. 4 is a perspective view of the mailer package of FIG. 3 in the closed position.

FIGS. 2–4 show the mailer package 10 which is formed by folding and bending the above-described portions of the blank 12. The mailer package 10 is formed by folding the first panel 18 along the first fold line 19 such that the first panel 18 forms approximately a right angle with the first side 22. The resulting fold produces a common first edge 19' of the first panel 18 and the first side 22. The first side 22 is then folded along the second fold line 21 forming approximately a right angle with the second panel 20 and such that the first panel 18 is parallel to, overlies and is spaced from the second panel 20. The resulting fold produces a common second edge 21'. The second side 24 is then folded along the third fold line 23 to form approximately a right angle with the second panel 20 to parallel the first side 22, resulting in a common third edge 23'. The closure tab 26 is folded along the fourth fold line 25 such that the closure tab 26 forms approximately a right angle with the first panel 18. As best shown in FIG. 2, when the second side 24 is folded along the third fold line 23, the closure tab 26 aligns with and contacts the surface of the second side 24 which is opposite the first side 22, and adheres to the second side 24 using the adhesive material thereon. A common fourth edge 25' is formed by the intersection of the first panel 18, the second side 24 and the closure tab 26. Those skilled in the art will recognize that adhesive material may be on the second side 24 in addition to or in place of adhesive on the closure tab 26.

Figure 9:
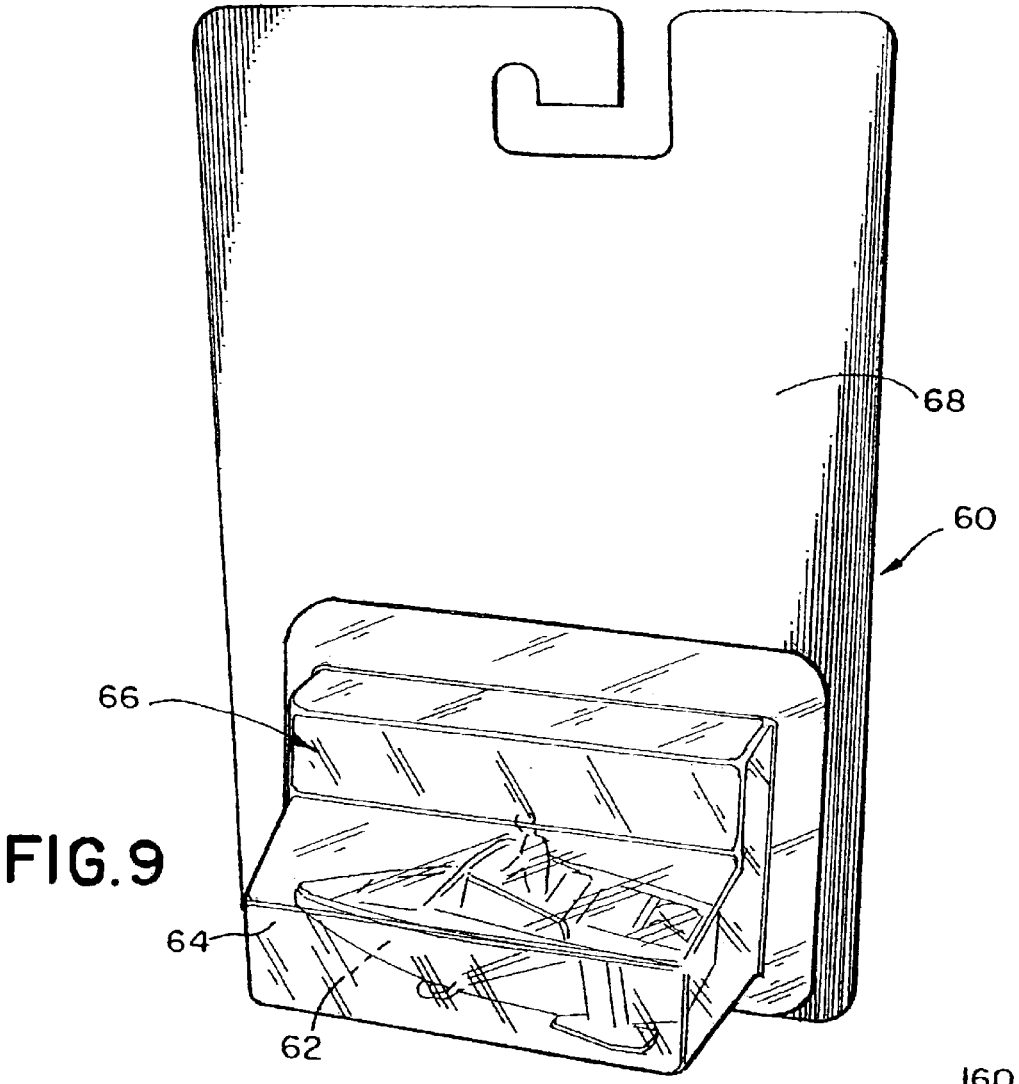
FIG. 9 is a perspective view of a second package containing a toy for mailing within the first embodiment mailer package of FIGS. 2–4.

A generally rectangular-shaped (parallelepiped) compartment 16 is thus formed by the first and second panels 18, 20 and the first and second sides 22, 24 by folding the blank 12 along the identified fold lines as described. The compartment 16 is sized to accommodate a second package 60 containing, for example, a toy 62 for mailing within the mailer package 10 (see FIG. 9). The second package 60 preferably includes a clear plastic cover 64 sealed to a substantially larger cardboard backing 68, thereby forming a generally rectangular-shaped (parallelepiped) toy compartment 66 containing the toy 62 therein. The compartment 16 includes first and second open ends 28, 30, respectively, at opposing ends of the compartment 16. The first and second open ends 28, 30 are closed by folding the side tabs 40 extending from each end 28, 30 of the first side 22 inward toward the compartment 16 along the first and second side tab fold lines 41, 42, respectively. Tabs 40 also extend from each end 28, 30 of the second side 24 along third and fourth side tab fold lines 43, 44, respectively. Each side tab 40 overlies at least a portion of first and second open ends 28, 30. The panel tabs 32 on the second panel 20 are then folded toward the compartment 16 along their respective third and fourth panel tab fold lines 35, 36 to overlie at least a portion of the first and second open ends 28, 30 and the folded side tabs 40 at each respective open end 28, 30. The panel tabs 32 on the first panel 18 are folded toward the compartment 16 along their respective first and second panel tab fold lines 33, 34 to overlie at least a portion of the first and second open ends 28, 30, the folded side tabs 40 at each respective open end 28, 30, and the folded panel tabs 32 from the second panel 20.

One or both of the panel tabs 32 at each of the first and second open ends 28, 30 preferably includes an adhesive material on a surface thereof, such that when the panel tabs 32 are folded about the first and second panel tab fold lines 33, 34, the panel tabs 32 from the first and second panels 18, 20 adhere together to securely close the first and second open ends 28, 30. Those skilled in the art will recognize that the panel tabs 32 on the second panel 20 may be folded over the panel tabs 32 on the first panel without departing from the spirit and scope of the present invention. Additionally, the number of tabs 32 and/or 40 at each open end 28, 30 may vary from one to four or more, so long as there is a sufficient number of tabs at each open end 28, 30 to cover and close each open end 28, 30.

The cover 14 is assembled by folding the second cover panel 52 about the cover fold 53 to substantially overlie the first cover panel 50 and form a cover edge 53' (see FIGS. 2 and 3). One or both of the first and second cover panels 50, 52 preferably includes an adhesive material such that the first and second cover panels 50, 52 are secured together when the second cover panel 52 overlies and contacts the first cover panel 50. The cover 14 is foldable about the fourth edge 25', as well as the fifth fold line 51, between an open position (see FIG. 3) and a closed position (see FIG. 4). Thus, a common fifth edge 51' is formed by the second side 24 and the cover 14. When the cover 14 is in the open position folded away from the compartment 16, the first panel 18 is exposed, such that the aperture 17 is visible, and, thus a substantial portion of the second package within the compartment 16 is seen. Those skilled in the art will recognize that the aperture 17 may be formed as a different size or in a different portion of the first panel 18. Additionally, the aperture 17 could be formed in the second panel 20 (with the cover 14 correspondingly designed to overlie the second panel 20) without departing from the spirit and scope of the present invention. When the cover 14 is in the closed position, the first and second cover panels 50, 52 form approximate right angles with the second side 24 and overlie at least a major portion of the first panel 18.

The closure flap 56 is removable from the cut-out 54 in the second cover panel 52 by unfolding the closure flap about the cover fold line 53. Thus, when the cover 14 is folded to the closed position, the closure flap 56 overlies the first side 22 such that the closure flap forms an approximate right angle with the cover 14. In the preferred embodiment of FIGS. 1–4, the cut-out portion 54 (and thus the closure flap 56) is formed such that the area interior to the second cover panel 52 from which the closure flap 56 is cut, is enclosed within the mailer package 10 when the cover 14 is in the closed position. However, those skilled in the art will recognize that the cut-out portion 54 and closure flap 56 could be formed such that the cut-out portion is on an outer surface of the mailer package 10 when the cover 14 is in the closed position without departing from the spirit and scope of the present invention.

The cover 14 is releasably secured in the closed position by adhering the attachment portion 59 of the closure flap 56 to the first side 22 using an adhesive material on the attachment portion 59 and/or the first side 22. The cover is releasable to the open position (from the closed position) by tearing the release tab 58 along the perforations 58*a*, 58*b*, thereby separating the release portion 57 from the attachment portion 59. The attachment portion 59 remains adhered to the first side 22, while the cover 14 is then freely rotatable about the fifth fold line 51 with the release portion 57. Those skilled in the art will recognize that the closure flap 56 could be formed to attach, for example, to the second panel 20, or another portion of the mailer package 10 such that the cover 14 is secured in the closed position.

In use, the mailer package 10 formed by folding the blank 12 made of the stock material. The compartment 16 is loaded with the second package 60 containing the toy 62 through either of the first and second ends 28, 30 which are then closed. A message or greeting may be printed on the first panel 18 and/or the inside of the cover 14 (i.e., the second cover panel 52) so that the recipient of the mailer package 10 sees the message upon opening the cover 14. The mailer package 10 may be sold unsealed so that a personal message or signature can be added. The cover 14 is folded into the closed position, and the closure flap 56 is attached to the first side 22 to securely close the mailer package 10. The mailer package 10 is then ready for mailing. Upon receipt, the mailer package 10 is opened by tearing the pull tab 58 to release the cover 14 and the release portion 57 from the attachment portion 59. The cover 14 is moved into the open position where the contents of the second package 60 within the compartment 16 are visible through the aperture 17. The compartment 16 may then be opened to remove the second package 60. The mailer package 10 thus provides a convenient compartment 16 in which to mail the second package 60, secured in a closed position for mailing by a cover formed from a double layer of the stock material and having an easy-open pull tab 58 for opening.

Referring to FIGS. 5–8, a second preferred embodiment of a mailer package, generally designated 110 in accordance with the present invention is shown. The mailer package 110 is designed to mail a small package containing a toy or other like device, or simply a toy placed directly within the compartment 116. Some of the features of the mailer package 110 were discussed above with respect to the first embodiment and have been omitted here for convenience only and should not be considered limiting.

Figure 5:
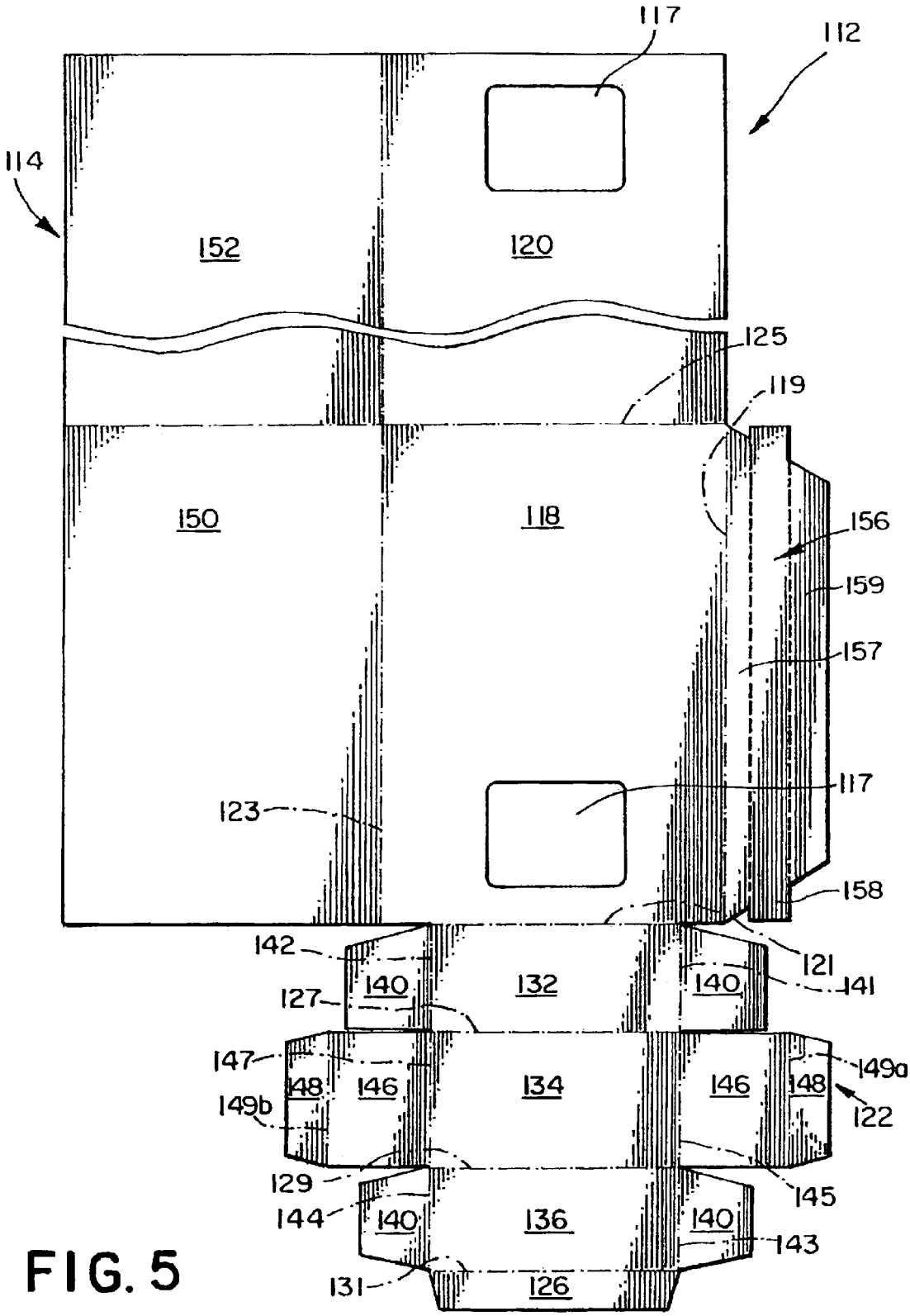
FIG. 5 is a top view of a blank of stock material used to form a mailer package according to a second embodiment of the present invention.

Referring now to FIG. 5, a cardboard blank 112 of the stock material which forms the mailer package 110 is shown. The blank 112 includes at least a first and preferably a second panel 118, 120, respectively. The first and second panels 118, 120 are preferably approximately the same shape and size. The second panel 120 extends from the first panel 118 along a fourth fold line 125. The first and second panels 118, 120 each include a preferably generally rectangular shaped aperture 117, formed from a cut out of the stock material from the blank 112.

A closure flap 156 extends from the first panel 118 along a first fold line 119. The closure flap 156 preferably includes a perforated pull tab 158, preferably in the form of a zip strip formed by lines of perforations 158*a*, 158*b*, which separates the closure flap 156 into a release portion 157 and an attachment portion 159 (see FIG. 6).

A compartment flap indicated generally by 122 extends from the first panel 118. The compartment flap 122 includes a first compartment side 132 which extends from the first panel 118 along a second fold line 121. A second compartment side 134 extends from the first compartment side 132 along a fifth fold line 127, and a third compartment side 136 extends from the second compartment side 134 along a sixth fold line 129. The first, second and third compartment sides 132, 134, 136 preferably have generally the same dimensions but side 134 can easily be differed in size from sides 132 and 136. A closure tab 126 extends from the third compartment side 136 along the length of a closure tab fold line 131. The closure tab 126 is preferably coated with an adhesive material on a surface thereof. The adhesive material is strong enough to securely attach the closure tab 126 to another portion of the stock material.

Flap tabs 140 extend from each end of the first compartment side 132 along flap tab fold lines 141, 142. Flap tabs 140 also extend from each end of the third compartment side 136 along flap tab fold lines 143, 144. Similarly, compartment tabs 146 extend from each end of the second compartment flap 134 along compartment tab fold lines 145, 147. End tabs 148 extend from the compartment tabs 146 along end tab fold lines 149*a*, 149*b*.

The blank 112 further includes a cover 114, formed from at least a first and preferably a second cover panel 150, 152, respectively. The first cover panel 150 extends from the first panel 118 along the length of a third fold line 123. The second cover panel 152 extends from the first cover panel 150 along the fourth fold line 125, such that the second cover panel 152 and the second panel 120 are joined along the third fold line 123. The first and second cover panels 150, 152 have preferably approximately the same dimensions as the first and second panels 118, 120.

Figure 6:
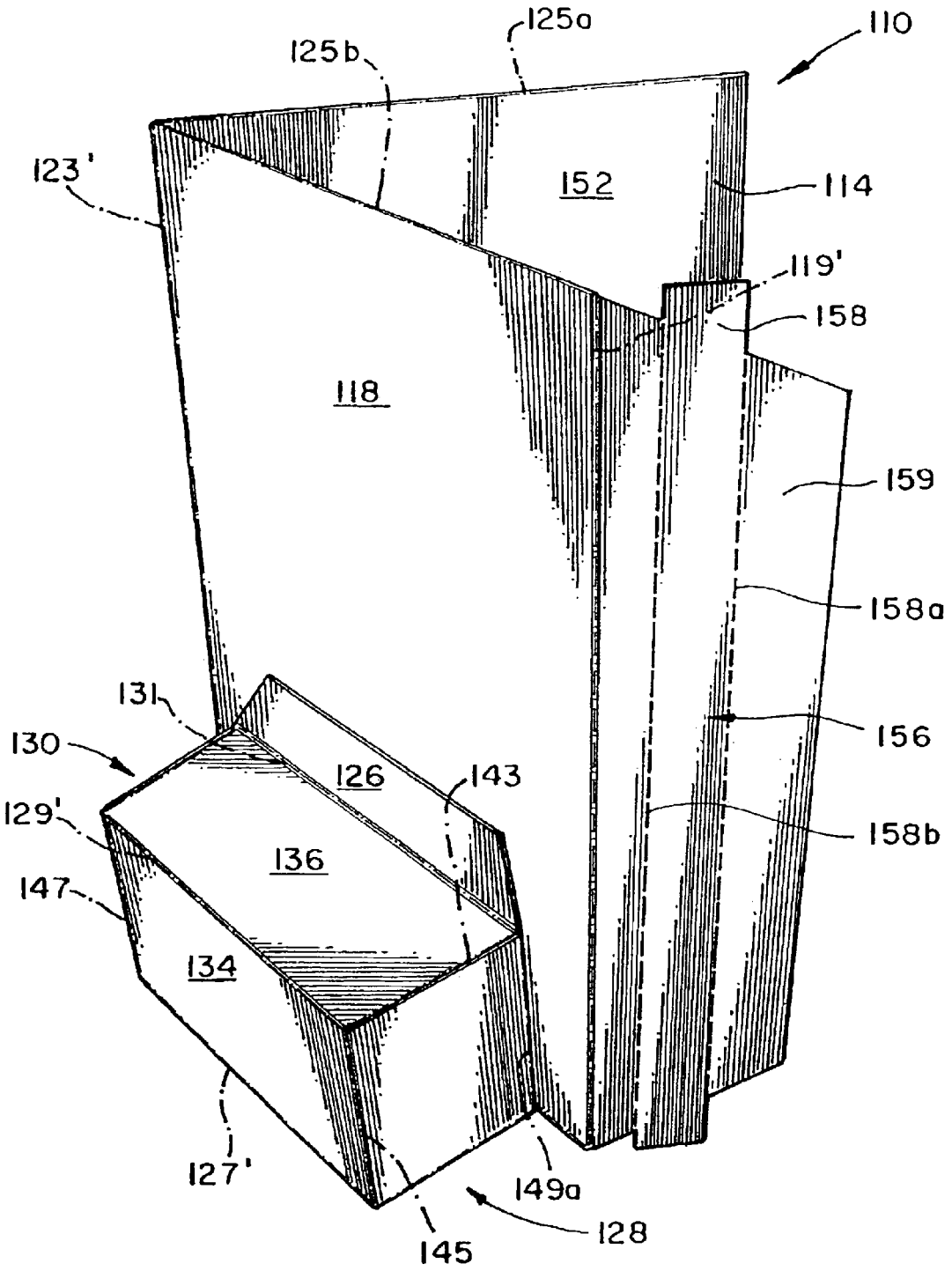
FIG. 6 is a rear perspective view of a mailer package formed from the blank shown in FIG. 1 in an open position.
Figure 7:
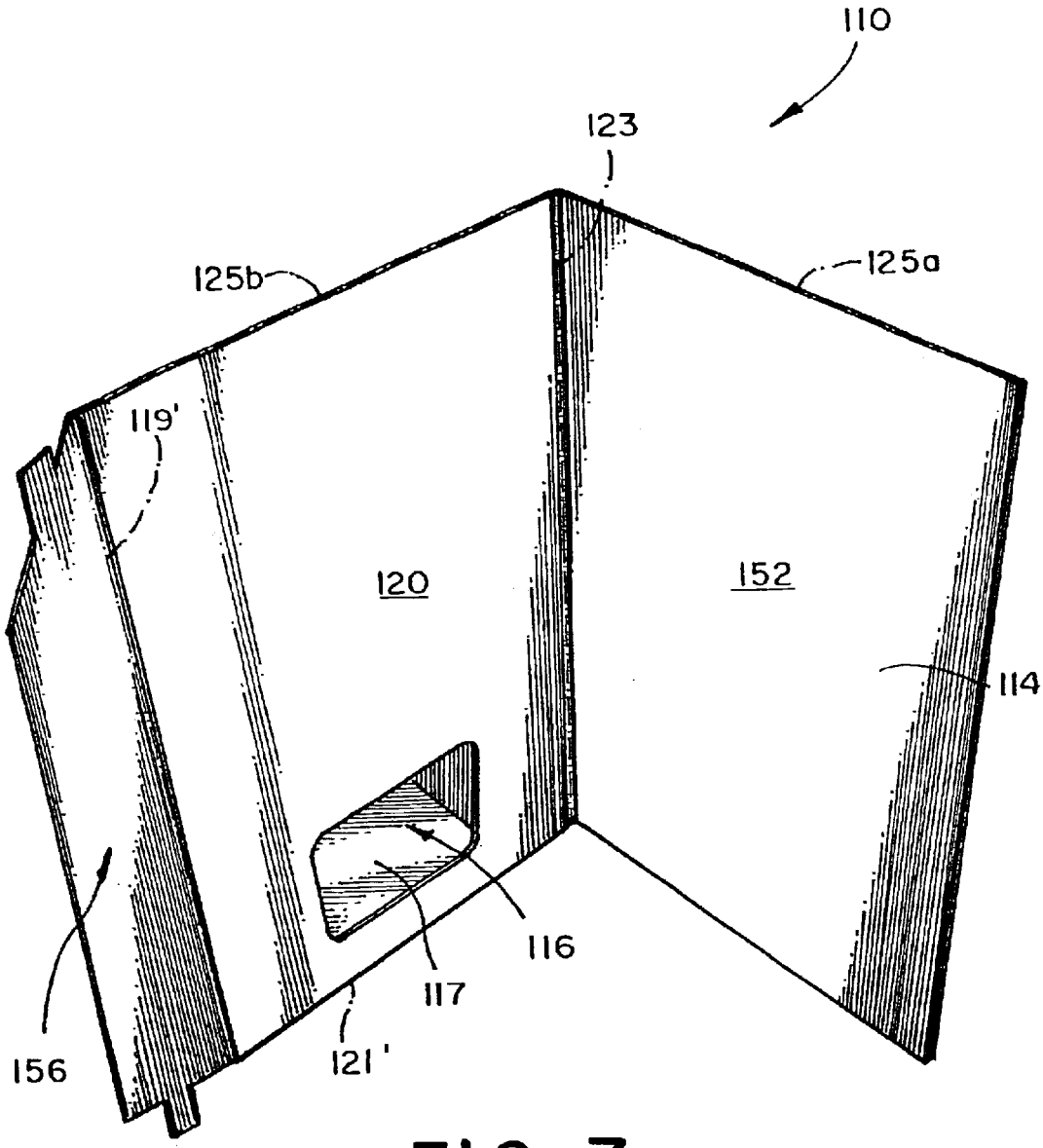
FIG. 7 is a front perspective view of the mailer package of FIG. 6.
Figure 8:
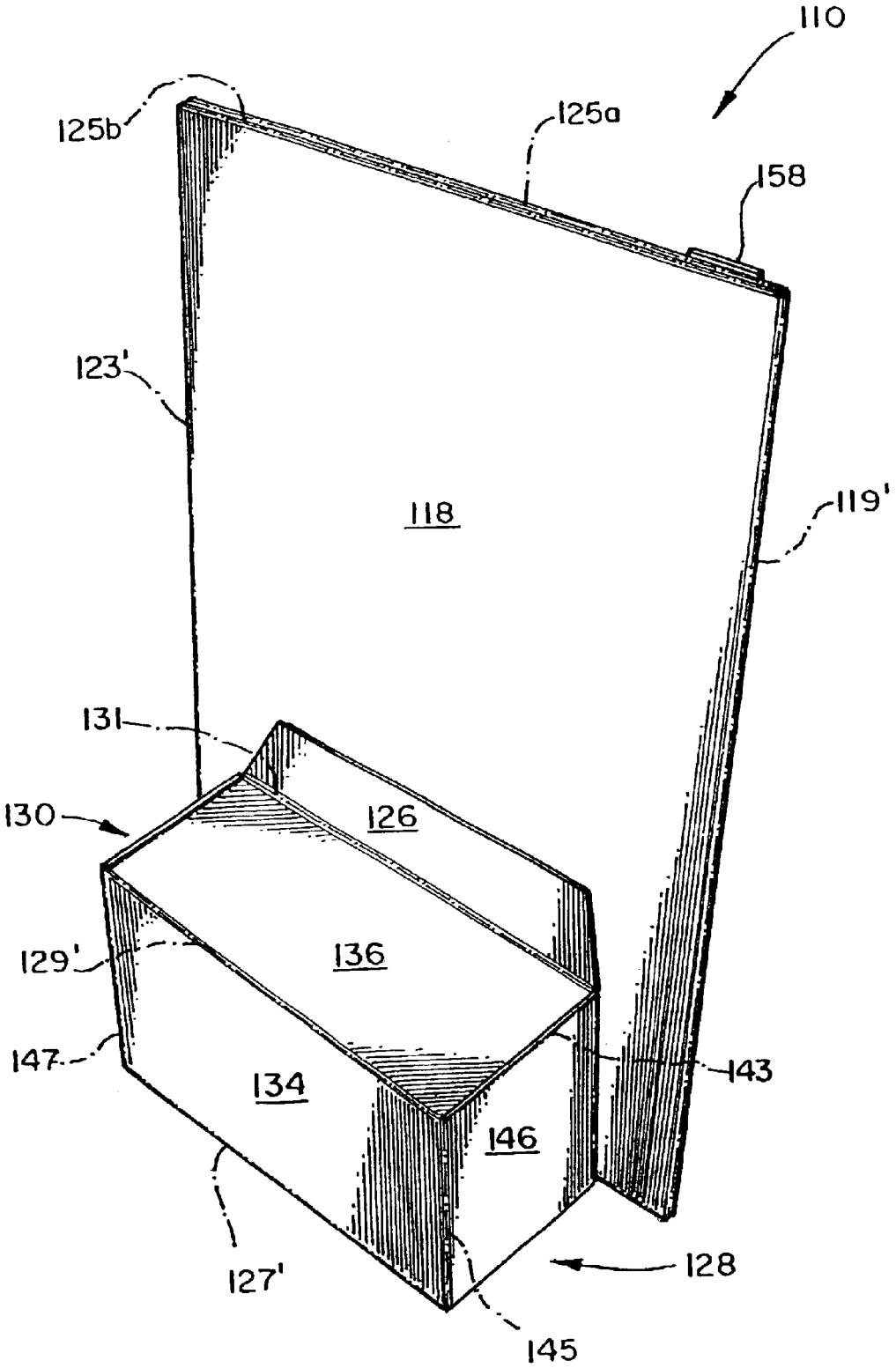
FIG. 8 is a perspective view of the mailer package of FIG. 6 in the closed position.

FIGS. 6–8 show the mailer package 110 which is formed by folding and bending the above-described portions of the blank 112. The mailer package 110 is formed by simultaneously folding the second panel 120 and the second cover panel 152 along the fourth fold line 125 such that the second panel 120 substantially overlies the first panel 118 (and the apertures 117 in each panel 118, 120 align) and the second cover panel 152 substantially overlies the first cover panel 150. The resulting fold produces common first edges 125*a* and 125*b*. The first and second panels 118, 120 are preferably secured together by an adhesive material on one or both of the panels 118, 120. Thus, the first and second panels 118, 120 essentially form a single, double layer panel having opposing first and second major sides. For convenience, this description refers to the first and second panels 118, 120, which are equivalent to the first and second major sides, respectively. Similarly, the first and second cover panels 150, 152 are preferably secured together by an adhesive material on one or both of the panels 150, 152.

The first compartment side 132 is then folded along the second fold line 121 forming approximately a right angle with the first panel 118. The resulting fold produces a common second edge 121'. The second compartment side 134 is then folded along the fifth fold line 127 to form approximately a right angle with the first compartment side 132 and such that the second compartment side 134 overlies and is spaced from the first panel 118. The resulting fold produces a common fifth edge 127'. The third compartment side 136 is then folded along the sixth fold line 129 forming approximately a right angle with the second compartment side 134, resulting in a common sixth edge 129' The closure tab 126 is folded along the closure fold line 131 forming approximately a right angle with the third compartment side 136 such that, the closure tab 126 is parallel with and contacts the first panel 118, such that the closure tab 26 adheres to the first panel 118 using the adhesive material thereon.

Figure 10:
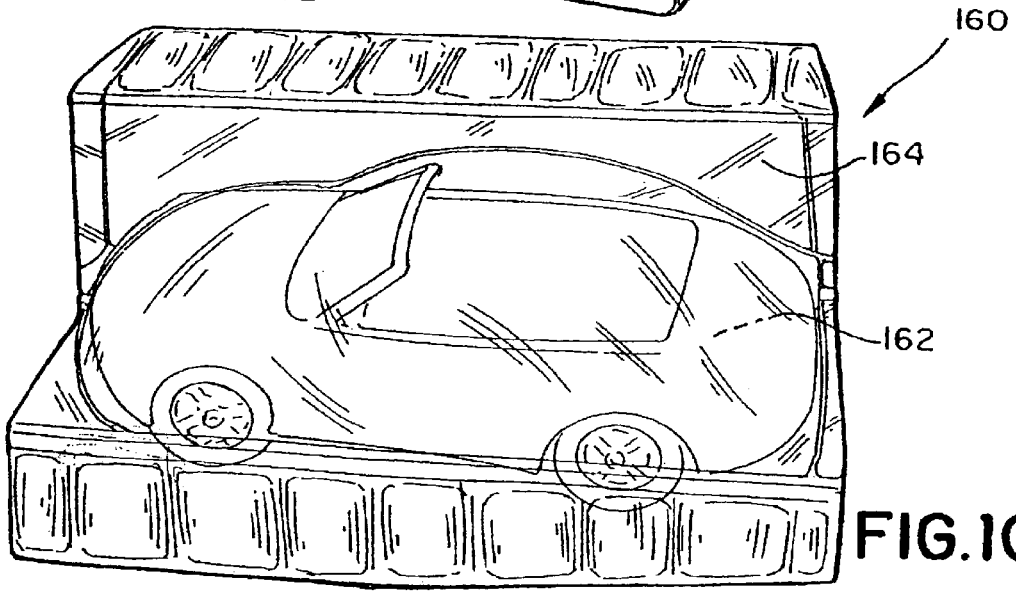
FIG. 10 is a perspective view of a second package containing a toy for mailing within the second embodiment mailer package of FIGS. 6–8.

By folding the blank 112 along the fold lines as described, a generally rectangular-shaped (parallelepiped) compartment 116 is thus formed by the first, second and third sequentially joined compartment sides 132, 134, 136 and a fourth sequential side formed by the first panel 118. Alternatively, the first panel 118 and the second compartment side 134 can be characterized as a first pair of parallel compartment panels (of different size) connected by the sides 132, 136 characterized as a first pair of parallel compartment sides to parallel the language of the first embodiment 10. The compartment 116 is sized to accommodate a second package 160 containing, for example, a toy 162 for mailing within the mailer package 110 (see FIG. 10). The second package 160 is preferably formed from a generally L-shaped plastic casing 164 having a recessed portion (shown in phantom in FIG. 10) shaped to hold a toy car therein. Alternatively, the loose toy 162 could be directly inserted into the compartment 116 without the second package 160. The compartment is preferable formed over and aligned with the apertures 117 in the first and second panels 118, 120, so that the contents of the compartment 116 may be seen through both panels 118, 120 from the opposite side.

The compartment 116 includes first and second open ends 128, 130, respectively (shown in FIGS. 6 and 8 as closed ends), at opposing ends of the compartment 116. The first and second open ends 128, 130 are closed by folding the flap tabs 140 extending from each end 128, 130 of the first compartment side 132 inward toward the compartment 116 along the flap tab fold lines 141, 142, respectively, and from each end 128, 130 of the third compartment side 136 along flap tab fold lines 143, 144, respectively. Each flap tab 140 overlies at least a portion of first and second open ends 128, 130. The end tabs 48 are then folded along their respective end tab fold lines 149*a*, 149*b* forming an approximate right angle with the compartment tabs 146 on the second compartment side 134. The compartment tabs 146 are then each folded toward the compartment 116 along their respective compartment tab fold lines 145, 147 to cover and close the first and second ends 128, 130. The end tabs 148 are releasably locked into place with the first sides 132, 136 and the folded flap tabs 140 at each respective open end 128, 130. Those skilled in the art will recognize that the number and configuration of the tabs 140, 146, 148 at each open end 128, 130 may vary, so long as there is a sufficient number of tabs (from one to four or more) at each open end 128, 130 to cover and close each open end 128, 130. Additionally, adhesive material may be used to securely close the first and second ends 128, 130.

The cover 114, formed from the overlying first and second cover panels 150, 152 is foldable about the third fold line 123, resulting in a common third edge 123' between the cover 114 and the overlying first and second panels 118, 120. The cover 114 is foldable between an open position (see FIGS. 6 and 7) and a closed position (see FIG. 8). When the cover 114 is in the open position folded away from the compartment 116, the second panel 120 is exposed, such that the apertures 117 are visible, and, thus a substantial portion of the contents within the compartment 116 is visible. Those skilled in the art will recognize that the apertures 117 may be formed as a different size or in different portions of the first and second panels 118, 120. When the cover 114 is in the closed position, the first and second cover panels 150, 152 overlie a major portion of the second panel 120.

The closure flap 156 is foldable along the first fold line 119, resulting in a first common edge 119' between the first and second panels 118, 120 and the closure flap 156. When the cover 114 is folded to the closed position, the closure flap 156 is folded along the first fold line 119 such that the closure flap 156 contacts and overlies the second panel 120. The cover 114 is releasably secured in the closed position by adhering the attachment portion 159 of the closure flap 156 to the cover panel 150 using an adhesive material on the attachment portion 159 and/or the cover panel 150. The cover 114 is releasable to the open position (from the closed position) by tearing the release tab 158 along the perforations 158*a*, 158*b*, thereby separating the release portion 157 from the attachment portion 159. The attachment portion 159 remains adhered to the cover panel 150, while the cover 114 is then freely rotatable about the first fold line 119. Those skilled in the art will recognize that the closure flap could be formed to attach to another portion of the mailer package 110 to secure the cover 114 in the closed position.

The use of the mailer package 10 is similar to that described above with respect to the mailer package 10. The compartment 116 is loaded with the loose toy 162 or second package 160 containing the toy 162 and any of the first and second ends 128, 130 which are open are then closed. The cover 114 is then folded into the closed position, and the closure flap 156 is attached to the cover panel 150. A message or greeting may be preprinted and/or hand written on the second panel 120 and/or the second cover panel 152 so that the recipient of the mailer package 110 sees the message upon opening the cover 114. The mailer package 110 is opened by tearing the pull tab 158 to release the cover 114 from the attachment portion 159. The cover 114 is moved into the open position where the contents of the second package 160 within the compartment 116 are visible through the apertures 117. The compartment 116 is then opened and the second package 160 or toy 162 removed.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A mailer package formed from a single sheet of foldable stock material comprising:

a first panel having opposing first and second major sides, the first panel having a closure flap with a tearable pull tab extending from a first edge;

a compartment flap extending from a second edge of the first panel, the compartment flap being foldable about the second edge, the compartment flap having an attachment tab and forming a compartment having first, second, third and fourth sequentially adjoining sides by attachment of the attachment tab to one of the first and second major sides of the first panel, the first, second and third sides of the compartment formed by folds in the compartment flap, the fourth side of the compartment formed by the one of the first and second major sides of the panel, the compartment having opposing first and second open ends;

a number of tabs at each of the first and second open ends sufficient to cover and close each open end, each separate tab extending from a separate one of the sides of the compartment at the open end; and a cover extending from a third edge of the first panel, the cover being foldable about the third edge between a closed position wherein the cover overlies the other of the first and second sides of the first panel and an open position folded away from the first panel, the cover being releasably secured in the closed position by attachment of the closure flap to the cover and the secured cover being moveable to the open position with release of the pull tab.

2. The mailer package of claim 1 wherein the first panel is formed from two mutually overlying layers of the stock material.

3. The mailer package of claim 1 wherein the cover is formed from two mutually overlying layers of the stock material such that the two overlying layers of the stock material of the cover overlie at least a major portion of the first panel when the cover is in the closed position.

4. The mailer package of claim 1 in combination with a toy in the compartment.

5. The mailer package of claim 1 wherein the one of the first and second sides of the fist panel has an aperture, the aperture being shaped and sized such that contents of the compartment are visible when the cover is in the open position.

6. The mailer package of claim 4 in further combination with a second package containing a toy in the compartment, the second package being aligned with the aperture such that the second package is visible when the cover is in the open position.

7. The mailer package of claim 1 wherein a portion of the closure flap remains attached to the cover after the pull tab is fully released.

8. The mailer package of claim 1 wherein the pull tab comprises a perforated zip strip.

* * * * *